US007484465B2

(12) United States Patent
Laby

(10) Patent No.: US 7,484,465 B2
(45) Date of Patent: Feb. 3, 2009

(54) FURNITURE STORAGE UNIT STRUCTURE AND CONSTRUCTION METHOD

(76) Inventor: Todd Laby, 4475 23rd St., #5, San Francisco, CA (US) 94114

( * ) Notice: Subject to any disclaimer, the term of this patent is extended or adjusted under 35 U.S.C. 154(b) by 0 days.

(21) Appl. No.: 11/148,788

(22) Filed: Jun. 6, 2005

(65) Prior Publication Data

US 2005/0223953 A1 Oct. 13, 2005

Related U.S. Application Data

(63) Continuation of application No. PCT/US03/40142, filed on Dec. 4, 2003.

(51) Int. Cl.
*A47B 47/00* (2006.01)

(52) U.S. Cl. ..... 108/180; 108/59; 108/60; 108/50.01; 211/206

(58) Field of Classification Search ..... 108/60, 108/61, 59, 67, 25, 26, 157.1, 162, 165, 166, 108/180, 153.1, 50.01; 312/184, 183, 193, 312/151, 404; 211/118, 113, 206, 12, 186
See application file for complete search history.

(56) References Cited

U.S. PATENT DOCUMENTS

| | | | | |
|---|---|---|---|---|
| 2,174,201 | A | 9/1939 | Chauvin | |
| 3,675,981 | A | 7/1972 | Mallander | |
| 3,995,924 | A | 12/1976 | Jones | |
| 4,232,596 | A * | 11/1980 | Kroll et al. | 312/184 |
| 4,400,107 | A * | 8/1983 | Pitts | 312/184 |
| 4,527,694 | A | 7/1985 | Bolt et al. | |
| 4,588,154 | A * | 5/1986 | Basore | 211/206 |
| 4,979,705 | A | 12/1990 | Bovitz | |
| 5,102,208 | A | 4/1992 | Joynes | |
| 5,190,252 | A | 3/1993 | Schrager | |
| 5,211,290 | A | 5/1993 | Janus et al. | |
| 5,238,139 | A | 8/1993 | Bisceglia | |
| 5,692,431 | A | 12/1997 | Herring | |
| 5,725,119 | A | 3/1998 | Bradford et al. | |
| 5,794,546 | A * | 8/1998 | Carter | 108/166 |
| 5,833,336 | A | 11/1998 | Dean | |
| 6,062,410 | A | 5/2000 | Bradford et al. | |

(Continued)

FOREIGN PATENT DOCUMENTS

| | | |
|---|---|---|
| GB | 696818 | 9/1953 |

(Continued)

*Primary Examiner*—José V Chen
(74) *Attorney, Agent, or Firm*—Freilich, Hornbaker & Rosen

(57) ABSTRACT

A furniture storage unit, and method of construction, configured to include one or more storage compartments each having dimensions (e.g., height and width) which can be readily varied by a user. The storage unit is configured to enable a user to arrange one or more compartments in a wide variety of configurations or patterns within the storage unit to optimize utility and aesthetic appeal. A storage compartment is formed by a suspended web of elongate flexible material having first and second hanger members respectively secured to the web at locations spaced along the web length. The first and second hanger members are configured to be supported by one or more rails at respective first and second locations longitudinally spaced along the rails. The hanger members suspend the web so that first and second spaced web portions hang substantially vertically bridged by an intermediate web portion suitable for supporting various objects, e.g., books.

11 Claims, 17 Drawing Sheets

U.S. PATENT DOCUMENTS

| | | | | |
|---|---|---|---|---|
| 6,230,916 | B1 | 5/2001 | Bradford et al. | |
| 6,364,133 | B1 | 4/2002 | Sheng | |
| 6,719,157 | B2 * | 4/2004 | Stoddart et al. | 211/118 |
| 6,880,902 | B2 * | 4/2005 | Zimmerman | 312/404 |
| 2005/0122017 | A1 * | 6/2005 | Son | 312/404 |
| 2005/0205650 | A1 * | 9/2005 | Founds | 312/184 |

FOREIGN PATENT DOCUMENTS

| | | | |
|---|---|---|---|
| WO | WO 9310024 | A1 * | 5/1993 |

* cited by examiner

FURNITURE STORAGE UNIT STRUCTURE AND CONSTRUCTION METHOD

RELATED APPLICATIONS

This application is a continuation of, and claims the benefit of, Application PCT/US2003/40142 filed on Dec. 04, 2003.

FIELD OF THE INVENTION

This invention relates generally to furniture storage units suitable for a variety of applications, e.g., bookcases, audio equipment cabinets, etc. More particularly, the invention is directed to a furniture storage unit structure, and method of construction, which enables a user to readily form various arrangements of one or more storage compartments where each compartment has height and width dimensions which can be readily varied to suit a user's needs and aesthetics.

BACKGROUND OF THE INVENTION

The prior art is replete with various furniture storage unit structures including some that enable a user to vary the dimensions of a storage compartment. For example only, bookcases are commonly constructed in a manner that enables a user to adjust the vertical spacing between parallel shelves.

SUMMARY OF THE INVENTION

The present invention is directed to a furniture storage unit, and method of construction, configured to include one or more storage compartments each having dimensions (e.g., height and width) which can be readily varied by a user. Moreover, embodiments of the invention enable a user to arrange one or more compartments in a wide variety of configurations or patterns within the storage unit to optimize utility and aesthetic appeal. A "furniture storage unit" in accordance with the invention is intended to broadly include free standing and wall mounted units as well as subsections of larger furniture pieces.

In accordance with the invention, a storage compartment is formed by suspending an elongate flexible web, where "web" is intended to broadly include any piece of flexible material, e.g., sheet material such as a solid or mesh fabric, or string material such as wire. More particularly, the web is suspended from a mounting structure in a manner which enables a user to select the location of the web as well as the size and aspect ratio of the storage compartment formed by the web.

A first type of mounting structure in accordance with the invention includes at least one horizontally oriented longitudinally extending support rail. The support rail preferably includes multiple detention devices, i.e., detents, e.g., notches, studs, bars, etc., spaced longitudinally along the rail, for retaining hanger members attached to and spaced along the web.

For example, in a first preferred embodiment, the hanger members comprise lateral rods configured to be supported between front and rear horizontally oriented longitudinal rails at respective notch locations longitudinally spaced along the rails. The hanger members suspend the web so that first and second spaced web portions hang substantially vertically from the hanger members and are bridged by an intermediate web portion which forms a compartment floor. In lieu of notched rails, the rails can be provided with laterally extending bars and/or studs for retaining the web hanger members, e.g., hooks or rings.

In accordance with a preferred embodiment, a rigid floor panel is mounted on the intermediate web portion to urge the suspended first and second web portions to a substantially vertical orientation parallel to one another and perpendicular to the floor panel. The floor panel provides a firm platform for supporting a variety of objects, e.g., books.

The hanger members and rails are cooperatively configured to enable the hanger members to be selectively retained at multiple locations longitudinally spaced along the rails. Thus, the spacing between the vertically suspended web portions can be readily varied by the user to achieve a desired compartment width. The user is also able to achieve a desired compartment height by choosing the length of suspended web material.

In an alternative embodiment, the mounting structure comprises a single rail having lateral bars cantilevered therefrom. Hanger members, e.g., hooks, extend around and are retained by selected one of the lateral bars.

In accordance with preferred embodiments of the invention, the rigid floor panels are configured to enable a user to readily adjust the overall width of the floor panel.

DETAILED DESCRIPTION

Figure 1:
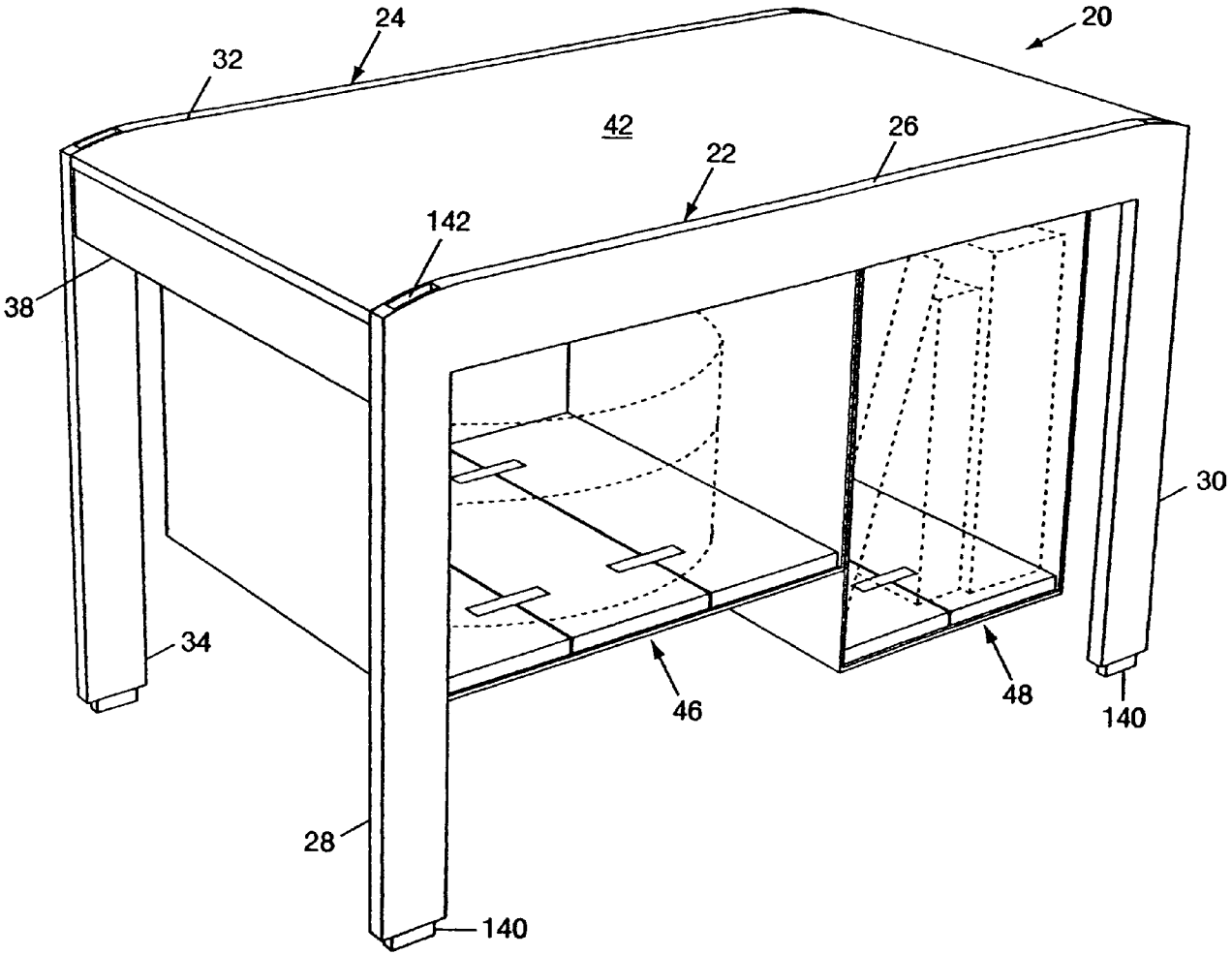
FIG. 1 is an isometric view of an exemplary furniture storage unit in accordance with the invention including storage compartments having variable user selectable height and width dimensions.
Figure 2:
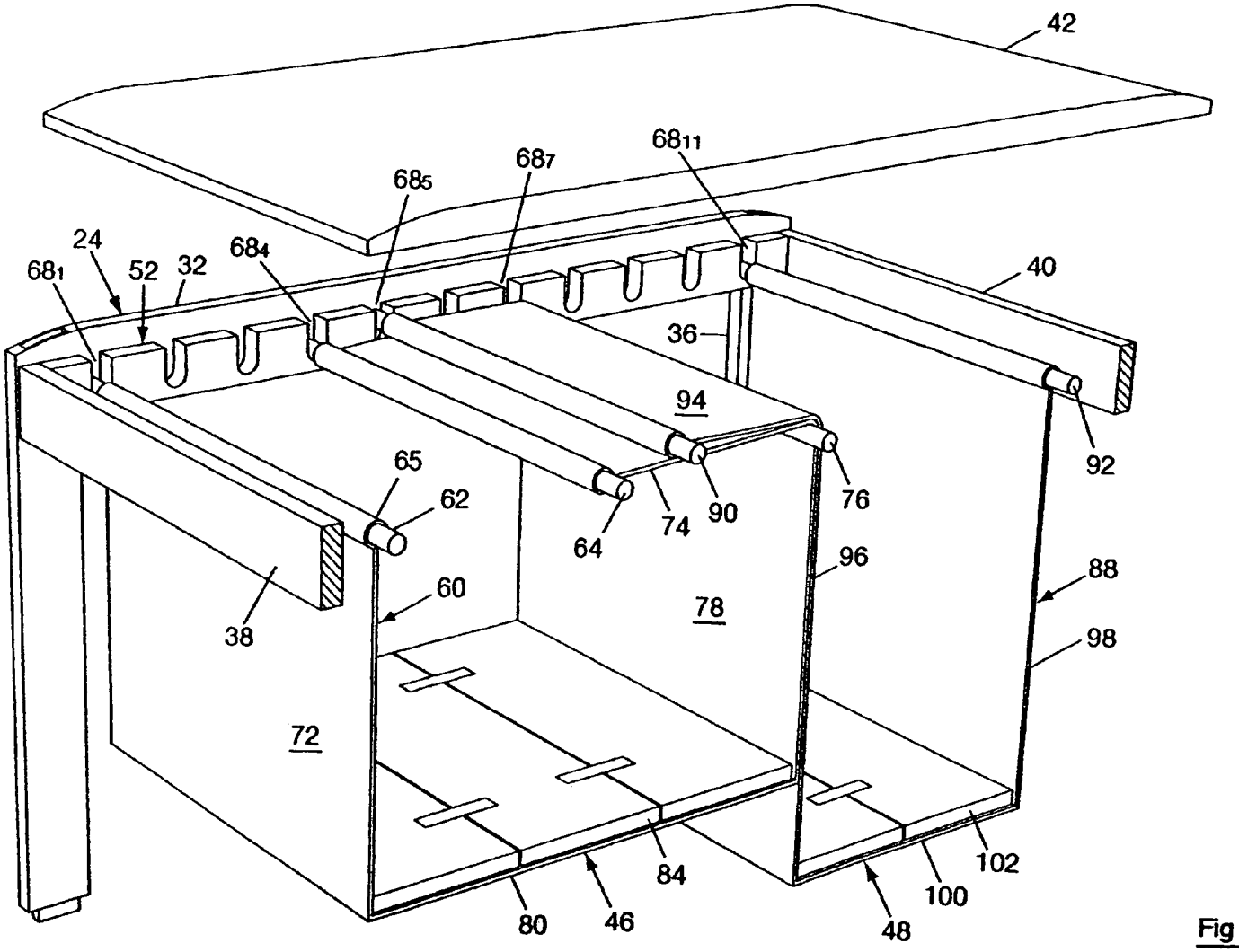
FIG. 2 is an exploded isometric view of the storage unit of FIG. 1 with the front frame removed.

Attention is initially directed to FIG. 1 which illustrates an exemplary furniture storage unit 20 in accordance with the present invention. The unit 20 is primarily comprised of a front frame 22 and a rear frame 24. The front frame 22 includes a longitudinal cross bar 26 having a left leg 28 and a right leg 30 depending therefrom. The rear frame 24 is similarly comprised of a longitudinal cross bar 32 having a left leg 34 and a right leg 36 (FIG. 2). The front and rear frames 22 and 24 are rigidly connected by a left lateral side bar 38 and a right lateral side bar 40 (FIG. 2). A top panel 42 preferably overlays the side bars 38 and 40 between the frames 22 and 24. The panel 42 is preferably dimensioned to fit between the cross bars 26 and 32 enabling it to be either lifted therefrom or slid longitudinally to provide access to the interior space between frames 22 and 24.

As shown in FIG. 1, the furniture storage unit 20 is configured to include multiple storage compartments, e.g., 46, 48, useful for storing a variety of everyday objects such as books, boxes, etc., as are represented by dashed line in FIG. 1. In accordance with the present invention, as will explained in greater detail hereinafter, the storage unit 20 is configured to enable a user to readily form various arrangements (and rearrangements) of storage compartments having height and width dimensions which can be readily varied by the user.

Figure 3:
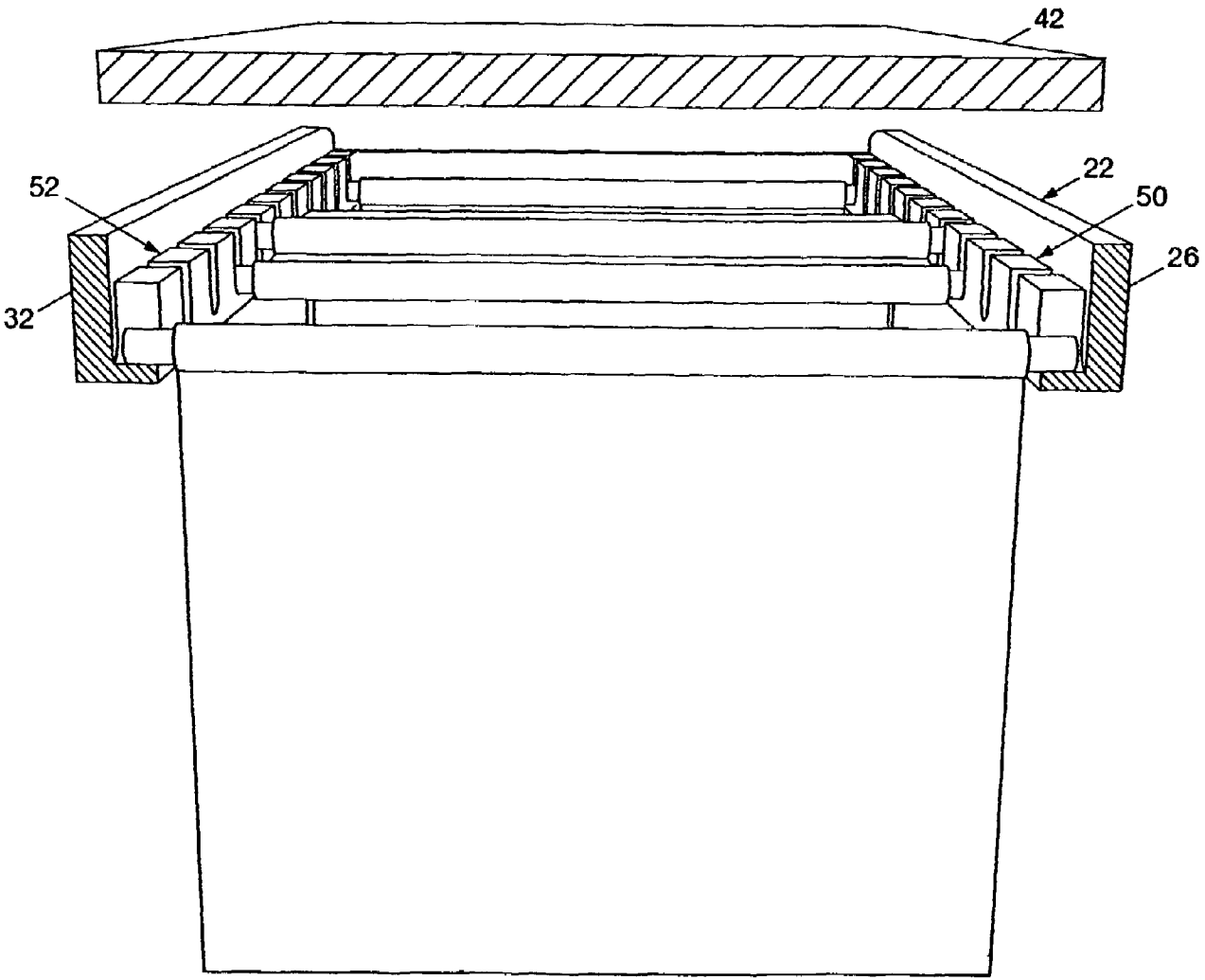
FIG. 3 is a perspective end view of the storage unit of FIG. 2 with the left legs and side bar deleted for clarity.

Attention is now directed to FIGS. 2 and 3 which illustrate exploded views of the storage unit 20 of FIG. 1 with certain structural elements removed to more clearly depict the interior structure of the storage unit. More particularly, note that cross bar 26 of the front frame 22 supports a front rail 50. Similarly, note that rear cross bar 32 supports a rear rail 52. As will be seen hereinafter, the front and rear rails 50, 52 function to suspend storage compartments formed by elongate flexible webs.

More particularly, and with reference to FIG. 2, note that storage compartment 46 is formed by a web of elongate flexible material 60 having a left, or first, hanger member 62 secured to one end thereof and a right, or second, hanger member 64 secured to a second end thereof. The hanger members 62, 64 can be secured to the web 60 by any suitable means such as by stapling or gluing, or extending through a passage 65 formed in the web material. The hanger members 62 and 64 can most simply comprise rods or dowels having a length sufficient to bridge the spacing between the front and rear rails 50 and 52. Preferably, the rails 50 and 52 are provided with multiple detents, e.g., notches, 68 spaced longitudinally along the length of the rails for supporting and retaining the hanger members.

Note in FIG. 2 that the first hanger member 62 is depicted as being accommodated in the first (left to right) notch $\mathbf{68}_1$, to suspend a first web portion 72 substantially vertically downward therefrom. Note also that the hanger member 64 is depicted as being accommodated in the fourth (left to right) notch $\mathbf{68}_4$. The web 60 could extend directly vertically downward therefrom but, to facilitate a wider range of possible configurations, FIG. 2 illustrates, as an example, a web portion 74 extending substantially horizontally from the hanger member 64 and around an intermediate deflection member 76, retained in the seventh rail notch (left to right) $\mathbf{68}_7$. The web portion 78 then extends vertically down from the member 76.

A substantially horizontally oriented intermediate web portion 80 extends between the aforementioned vertically oriented web portions 72 and 78. The web portions 72, 80, and 78 define the outer boundary of the storage compartment 46 with the intermediate portion 80 forming a compartment floor. The height of the compartment is defined by the lengths of the vertical web portions 72, 78. The width of the compartment is defined by the horizontally oriented web intermediate portion 80 between vertically oriented web portions 72 and 78.

In order to lend rigidity or stiffness to the structure of compartment 46 formed by the flexible web material 60, it is preferable to provide a substantially rigid floor panel 84 having a width corresponding to the compartment width; i.e., the spacing between vertical web portions 72 and 78. The floor panel 84 is preferably supported on intermediate web portion 80 and functions to maintain the web portions 72, 78 substantially parallel to one another. As will be discussed hereinafter, the floor panel 84 is preferably configured to have an adjustable width to enable a user to more conveniently differently dimensioned compartments.

It is pointed out that FIG. 2 also illustrates the construction of a second storage compartment 48 which is defined by a flexible web 88 extending between left hanger member 90 and right hanger member 92. FIG. 2 depicts hanger members 90 and 92 respectively retained in the fifth ($\mathbf{68}_5$) and eleventh ($\mathbf{68}_{11}$) rail notches. Note that the web 88 is depicted as including a first web portion 94 extending essentially horizontally from hanger member 90 and around the aforementioned intermediate member 76 to a vertically oriented left web portion 96. The web 88 is depicted as also including a web portion 98 which drops substantially vertically from the right hanger member 92. Intermediate web portion 100 extends between the substantially vertically oriented web portions 96 and 98. A substantially rigid floor panel 102 is supported on the intermediate web portion 100.

Figure 4:
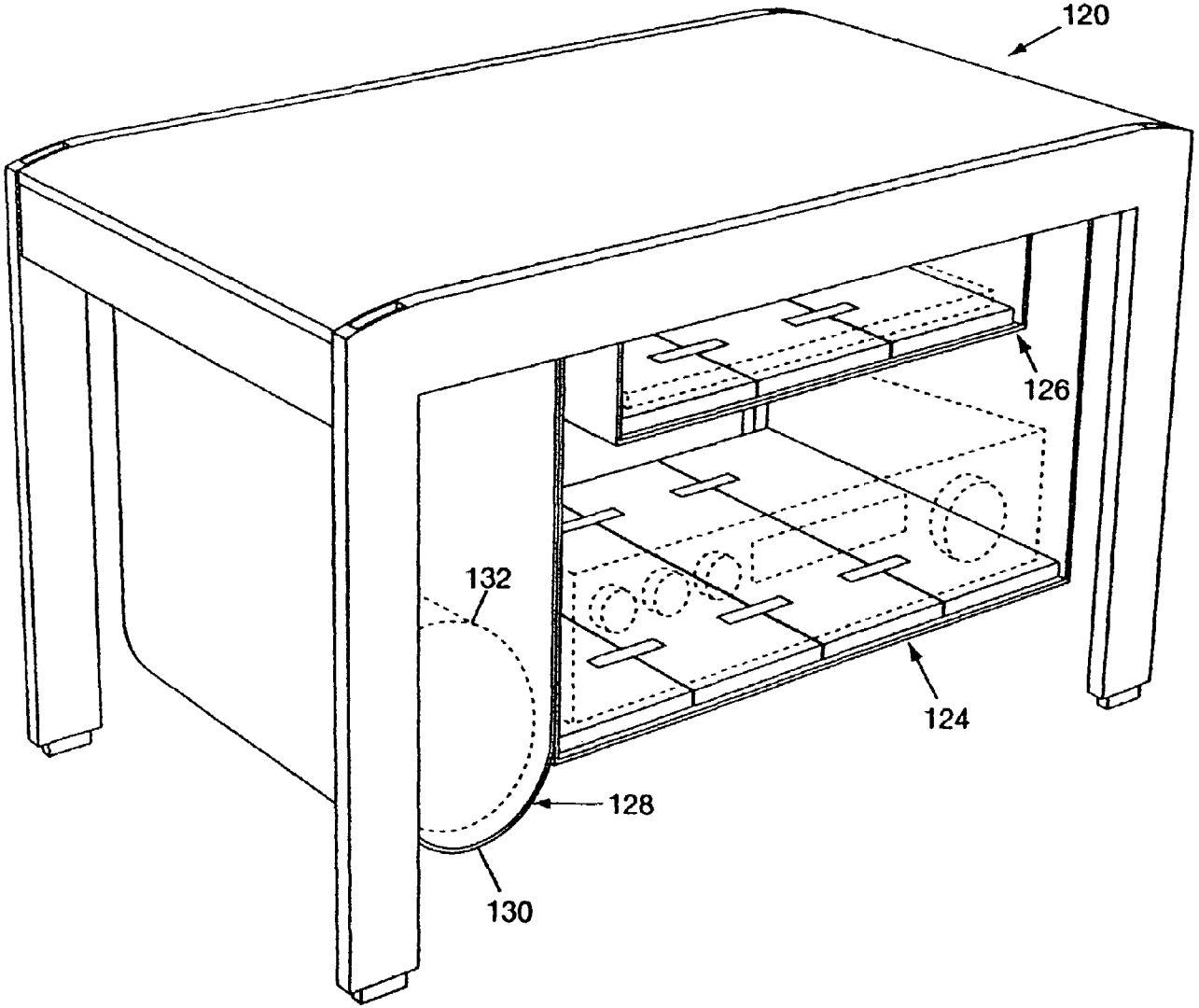
FIG. 4 is an isometric view of another exemplary furniture storage unit similar to the unit of FIG. 1 but with the storage compartments differently arranged.

Attention is now directed to FIG. 4 which illustrates a second exemplary furniture storage unit 120. The unit 120 is constructed identically to the aforementioned unit 20 but is depicted in FIG. 4 as containing a different user defined configuration of storage compartments. More particularly, note that the unit 120 depicts a large storage compartment 124 and a smaller storage compartment 126 contained within the compartment 124. Also note the formation of a third compartment 128. Whereas the previously mentioned compartments have all been shown with floor panels therein to rigidify the compartment boundary formed by the flexible web, the compartment 128 is depicted without the floor panel so that its intermediate web portion 138 sags as shown to better accommodate certain objects, such as the cylindrical object 132 depicted in dashed line in FIG. 4. From the previous discussion of FIGS. 1-3, it should be apparent that the compartments 124. 126, and 128 can be formed by suspending respective webs from hanger members supported by rail members secured to the frame.

Figure 5A:
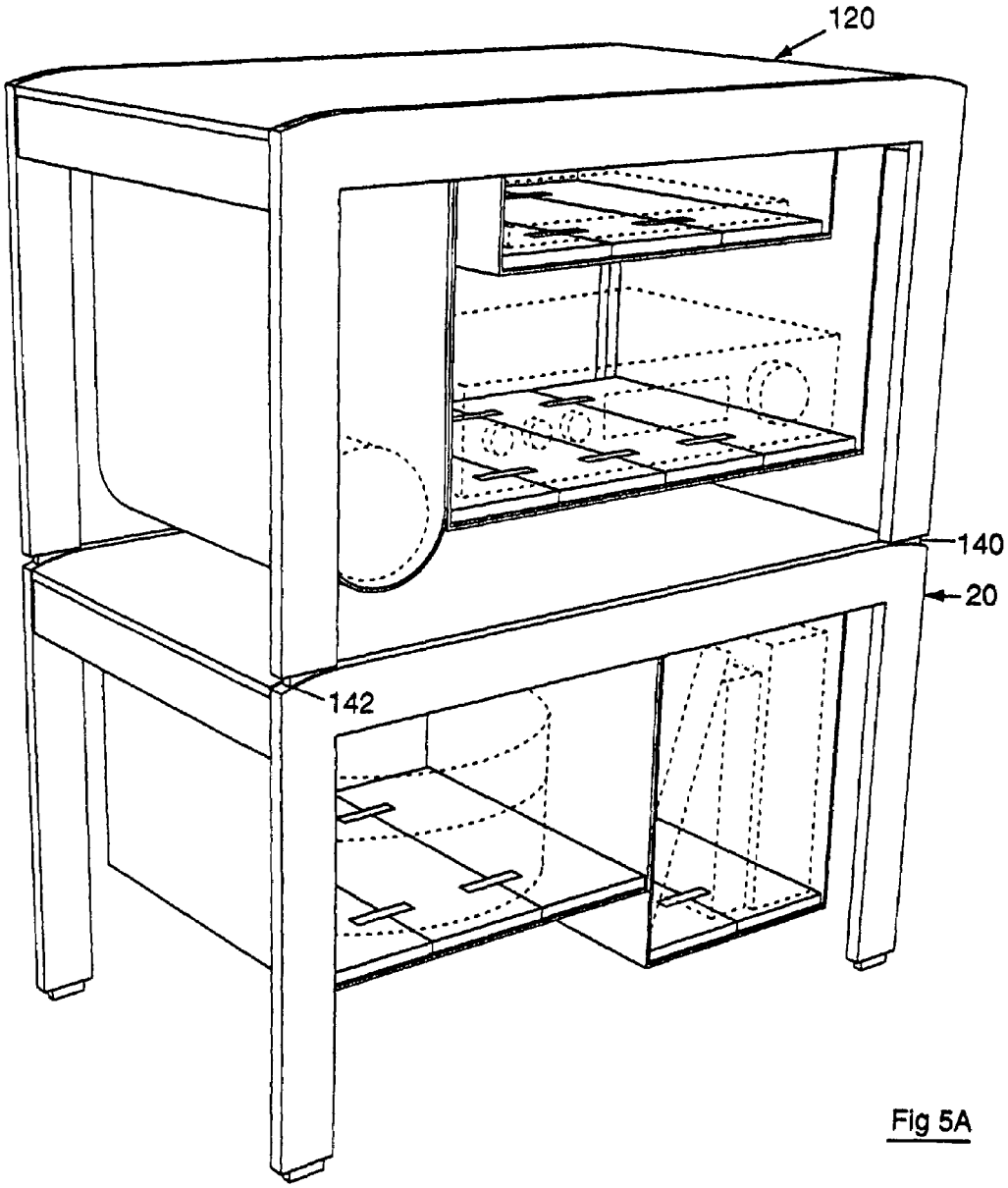
FIG. 5A is an isometric view showing how two units (e.g., units of FIGS. 1 and 4) can be used together in a stacked relationship

It is pointed out that the aforementioned legs 28, 30, 34, and 36 depicted in FIGS. 1 and 2 are all formed with reduced cross section extensions 140 at their lower ends. Also note in FIGS. 1 and 2 that the frame cross bars 26 and 32 have apertures 142 formed on their upper surface. The apertures 142 are dimensioned to snugly accommodate the leg extensions 140 of a different unit. More particularly, attention is now called to FIG. 5A which illustrates the storage unit 120 stacked on top of the storage unit 20. Note that the lower leg extensions 140 of unit 120 extend into and are snugly received in the apertures 142 of lower unit 20. By configuring the storage units so that that they can be readily stacked and by enabling a user to arrange configurations of multiple compartments of user variable dimensions, it should be recognized that applicant has provided an extremely, flexible, and relatively inexpensive unit useful in a multiplicity of applications for storing a variety of objects.

Figure 5B:
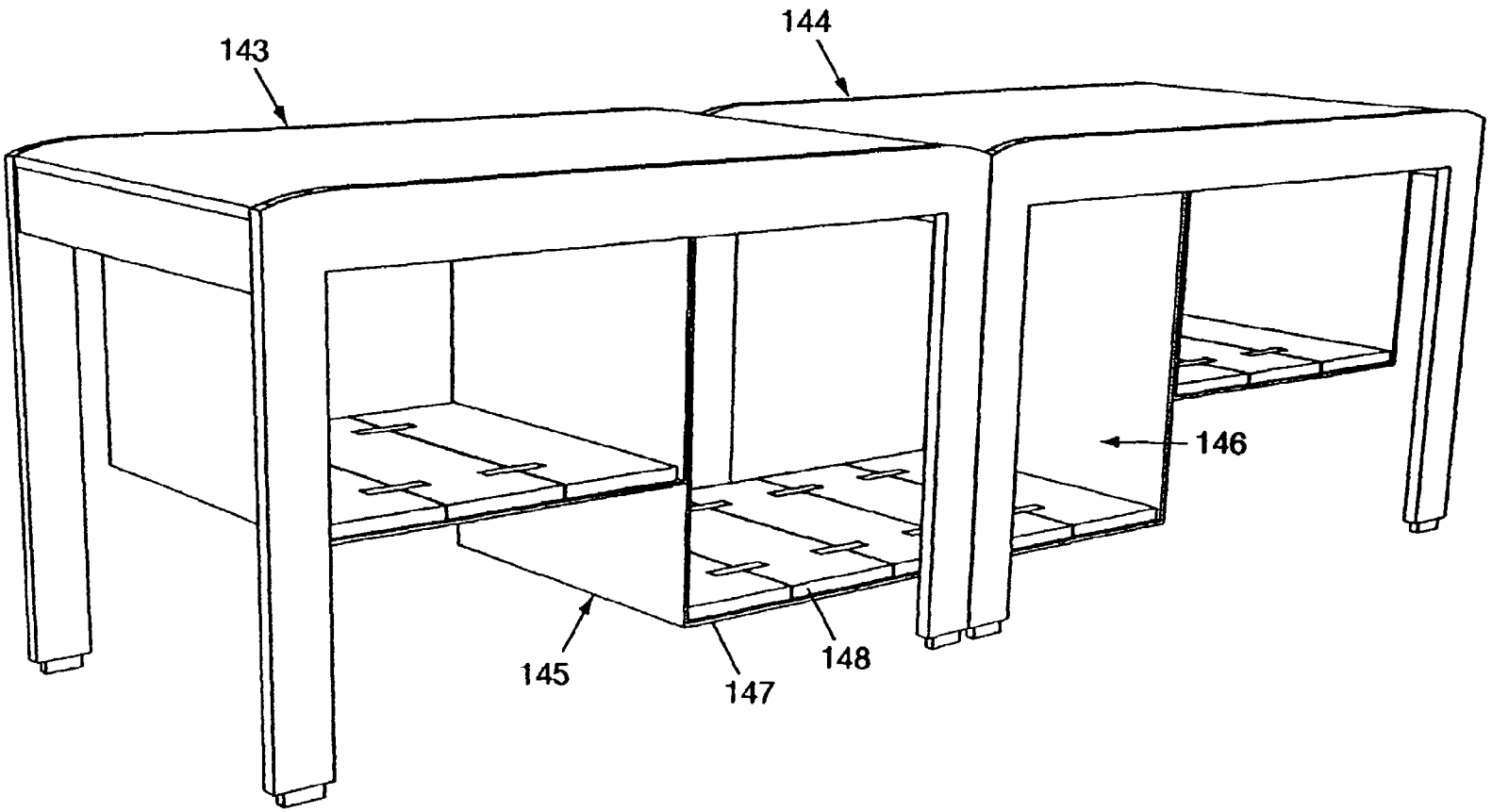
FIG. 5B is an isometric view showing how two units can be used together in a side by side relationship.

FIG. 5B depicts two of the storage units 143, 144 positioned in side by side relationship particularly to show that a single web 145 can form a storage compartment 146 bridging the two units. That is, left and right hanger members (not shown) attached to the web 145 are respectively suspended from the units 143 and 144 to form a compartment floor 147 carrying a floor panel 148.

Figure 6:
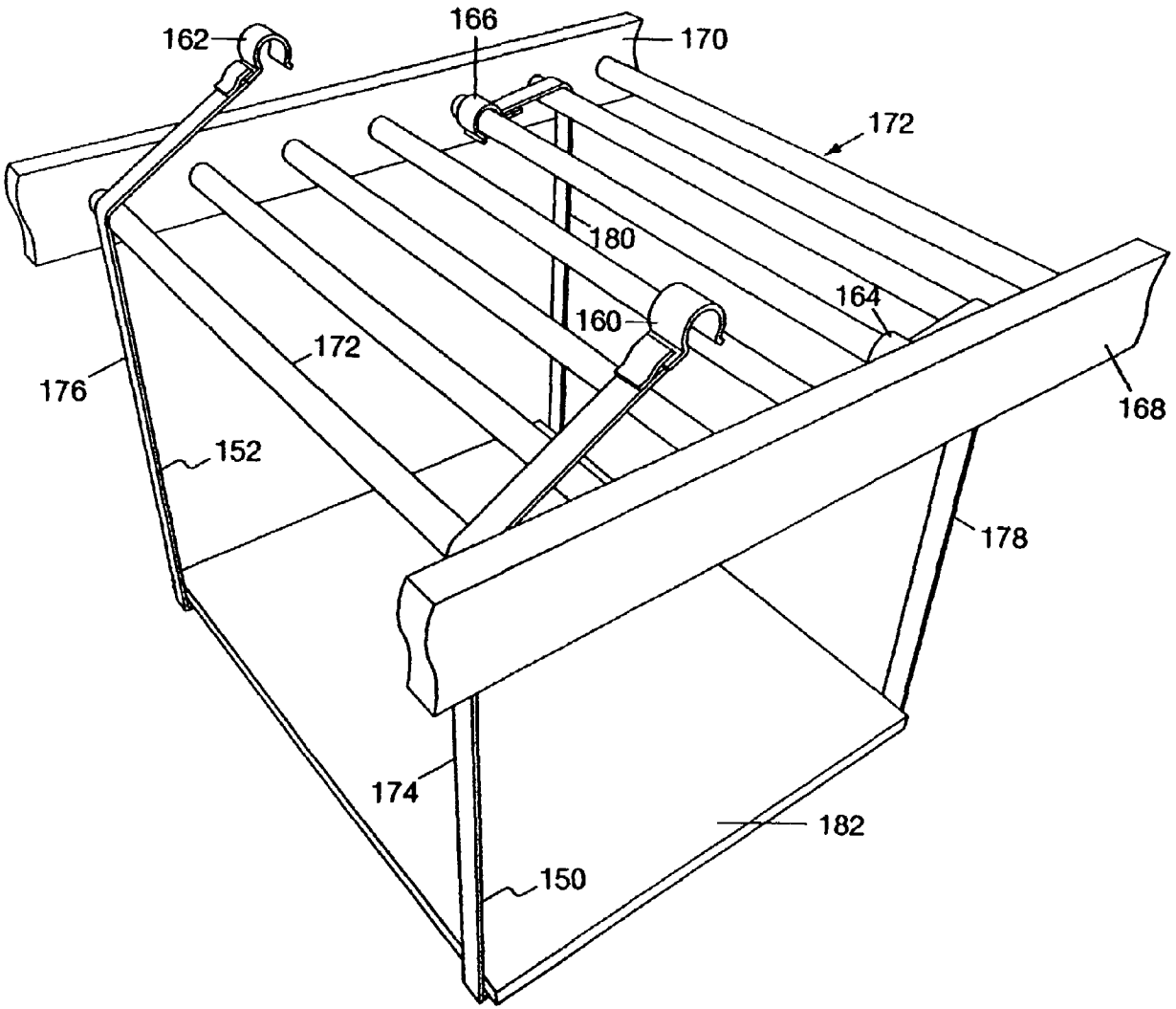
FIG. 6 is an isometric schematic representation of a first alternative embodiment of the invention.

Although the embodiments thus far described depict a web having a width equal to the depth of the storage compartment and hanger members comprising simple rods or dowels accommodated in selected notches in spaced supporting rails, it should be understood that embodiments of the invention can employ a variety of alternative structures. For example, attention is directed to FIG. 6 which illustrates an alternative manner of forming a compartment using a suspended flexible web. In the embodiment of FIGS. 1-3, the web comprised an integral piece of material having a width substantially equal to the compartment depth. In contrast, in the embodiment of FIG. 6, the web is comprised of two or more spaced narrow webs, e.g., straps or wires 150, 152.

Hanger members 160, 162 are respectively secured to the first or left end of the straps 150, 152. Hanger members 164, 166 are respectively secured to the second or right end of the straps 150, 152. In lieu of the notched rails used in the embodiment of FIGS. 1-3, FIG. 6 spaced front and rear longitudinal rails 168, 170 connected by a plurality of lateral bars 172. Each hanger member 160, 162, 164, 166 is configured to hook around and be retained by one of the bars 172 thus enabling first, or left portions 174, 176 of the straps 150, 152 to hang vertically. Similarly, second, or right portions 178, 180 of the straps are suspended to hang vertically. A rigid floor panel 182 is preferably supported on intermediate portions of the straps bridging the vertical strap portions.

Figure 7:
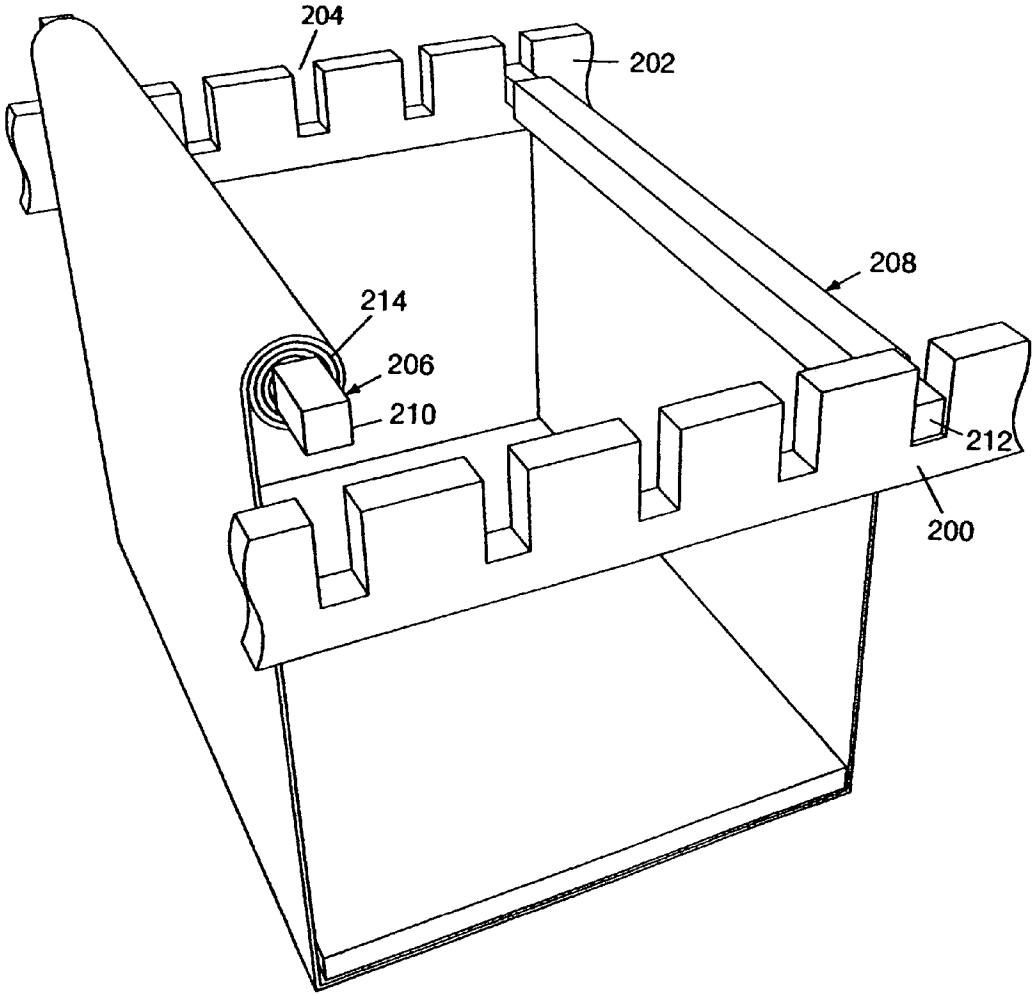
FIG. 7 is an isometric schematic representation of a second alternative embodiment of the invention.

FIG. 7 illustrates a still further alternative embodiment in which the front and rear rails 200, 202 define rectangular notches 204 spaced along the length of the rails. The hanger members 206, 208 comprise elongate rods having rectangular ends 210, 212 dimensioned to fit snugly in the recesses 204 to prevent the rods from rotating relative to the rails. As a consequence, excess web material can be wound around one or both of the rods (depicted at 214) in order to provide a suspended web length appropriate to form a storage compartment of desired dimensions.

Figure 8:
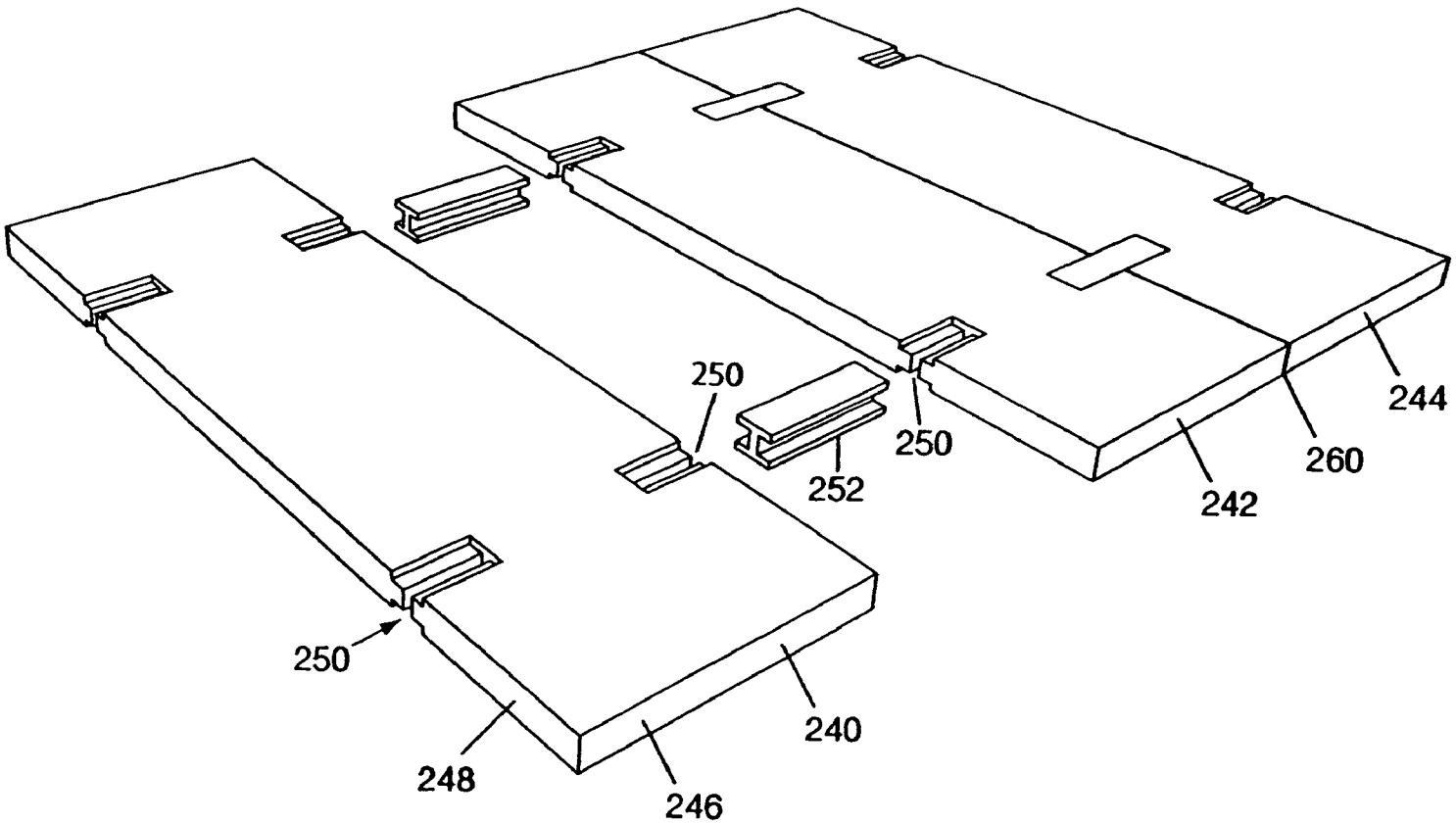
FIG. 8 is an isometric partially exploded view of a preferred adjustable width floor panel useful in the storage unit of FIG. 1.

Reference has been made in FIGS. 1-3 to a substantially rigid floor panel, e.g., 84, which is mounted between suspended vertical web portions, e.g., 72, 78 for spacing the web portions and providing a firm compartment floor for supporting various objects. It has been pointed out that the floor panel 84 should preferably have a width dimension corresponding to the spacing between the vertical web portions which, of course, can be varied by the user to the resolution defined by the spacing between notches 68, formed in the front and rear rails 50, 52. In order to provide a user with a high degree of flexibility in choosing his compartment dimensions and configurations, it is preferable to utilize a floor panel having an adjustable width. FIG. 8 illustrates a first adjustable width floor panel embodiment in which relatively narrow floor panel modules 240, 242, 244 can be readily secured together to form a wider composite floor panel. Note that each of the floor panel modules has a short side 246 and a long side 248 approximating the intended depth of the storage compartment being formed. Specially configured I-beam slots 250 extend inwardly from the long sides 248 of the floor panel modules. Similarly configured connectors 252 are dimensioned to extend into opposing slots 250 in adjacent modules, e.g., 240 242, to secure the modules together and enable opposed long sides of the respective modules to substantially abut, as for example as shown at 260 between modules 242 and 244.

The arrangement shown in FIG. 8 provides a solid substantially rigid floor panel capable of supporting the weight of the intended objects to be stored. Modules of varying width can be provided. For example, a practical embodiment would include multiple modules having three inch and/or six inch widths enabling compartments of various widths to be formed, e.g., 9 inches, 12 inches, 15 inches, 18 inches, etc. A simpler alternative to the arrangement depicted in FIG. 8 would substitute pins (or dowels) (not shown) for the I-beam connectors 252 and straight bores (not shown) extending into adjacent long edges of the modules for the slots 250. The pins are dimensioned to be snugly received in the bores for connecting adjacent modules to form a rigid floor panel.

Figure 9:
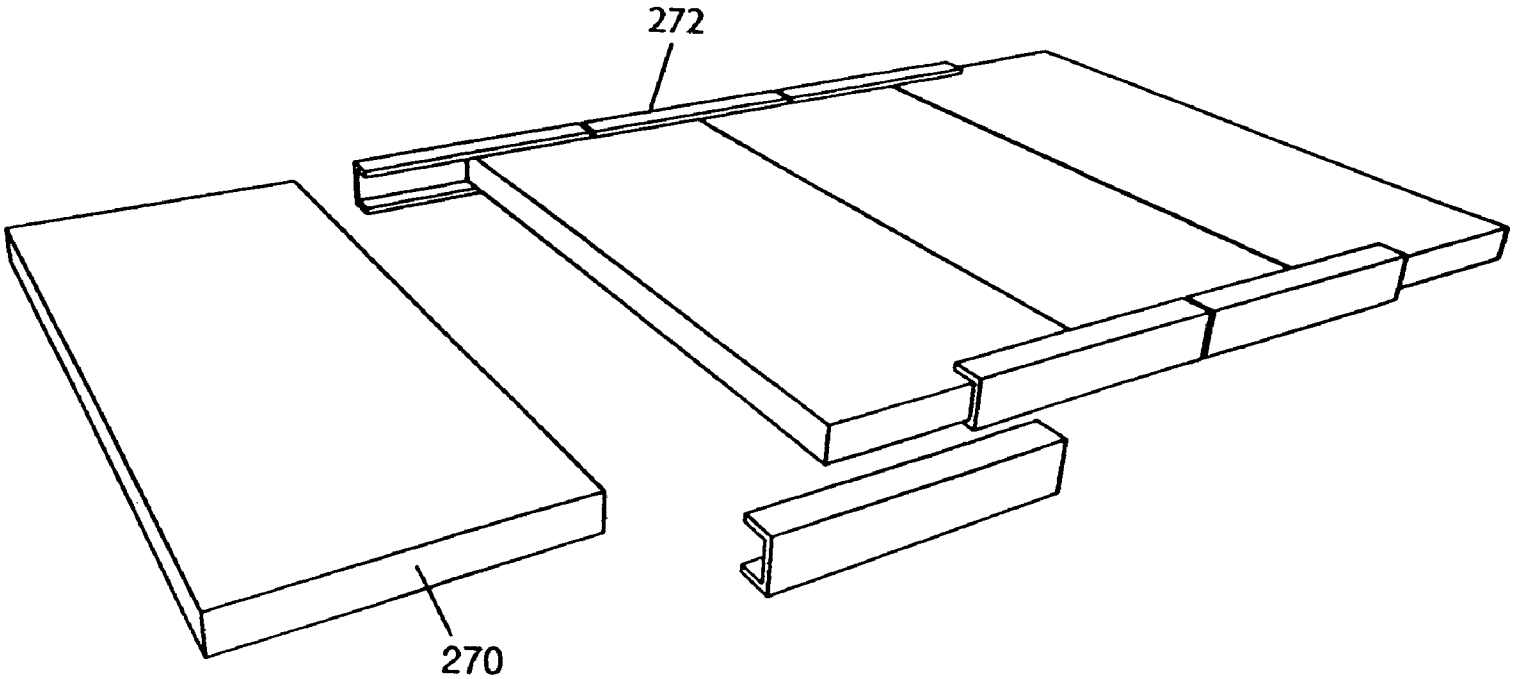
FIG. 9 is an isometric partially exploded view of a first alternative adjustable width floor panel construction.

FIG. 9 depicts a further adjustable floor panel embodiment in which floor panel modules 270 are secured together by edge channel connectors 272. Note that in assembling the floor panel in accordance with the embodiment of FIG. 9, each edge panel connector 272 preferably bridges half the width of each of two adjacent panel modules.

Figure 10:
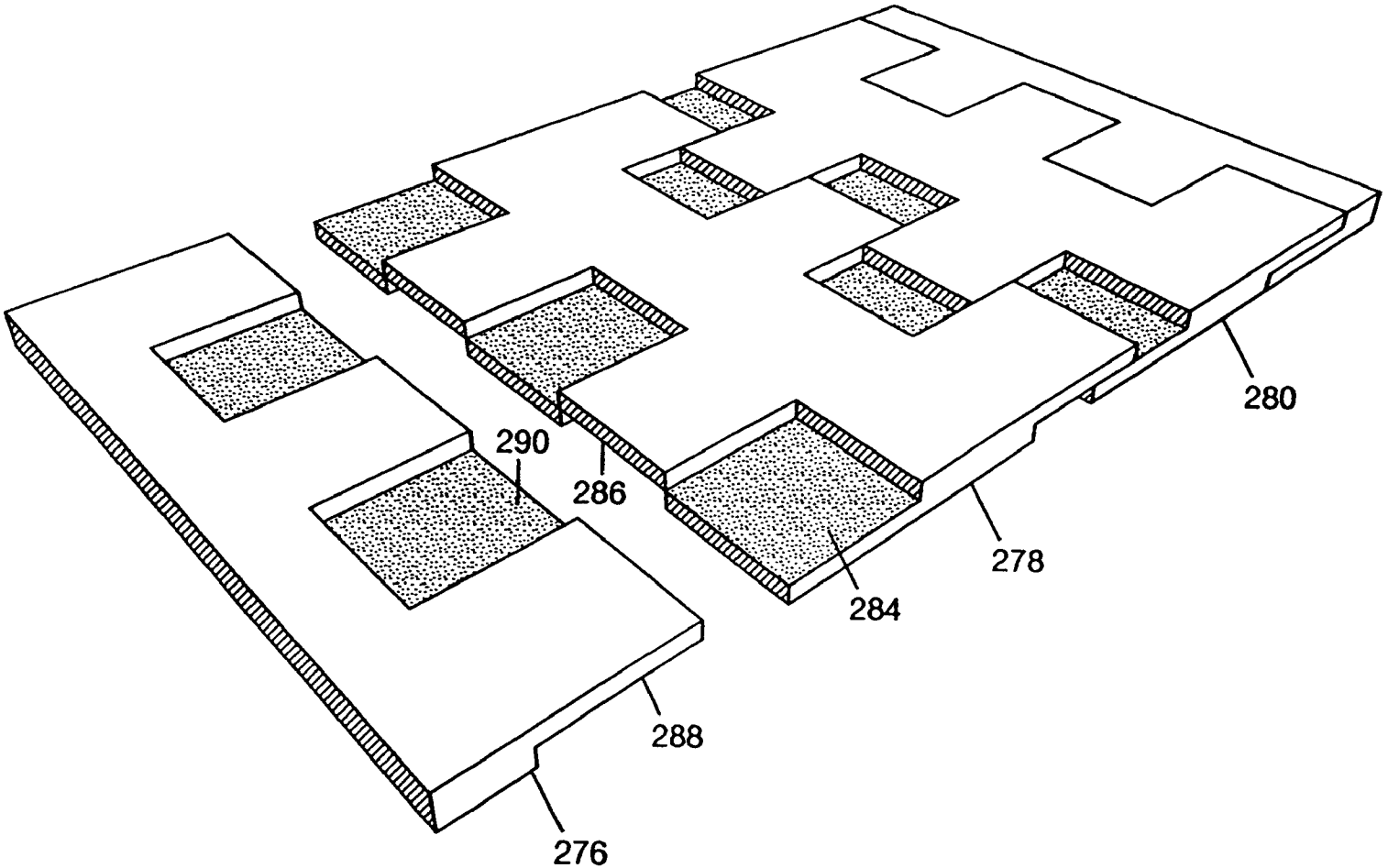
FIG. 10 is an isometric partially exploded view of a second alternative adjustable width floor panel construction.

FIG. 10 illustrates a still further adjustable floor panel embodiment which can be assembled from multiple modules 276, 278, 280, etc. Note that each module, e.g., 278, includes portions 284 which are relieved from a top surface and portions 286 which are relieved from a bottom surface. An adjacent panel module, e.g., 276 includes oppositely relieved portions. That is, panel 276 is relieved from the undersurface at 288 and from the top surface at 290. This enables the adjacent panel modules 276 and 284 to be slid together to provide a substantially rigid structure to serve as a compartment floor panel.

Figure 11:
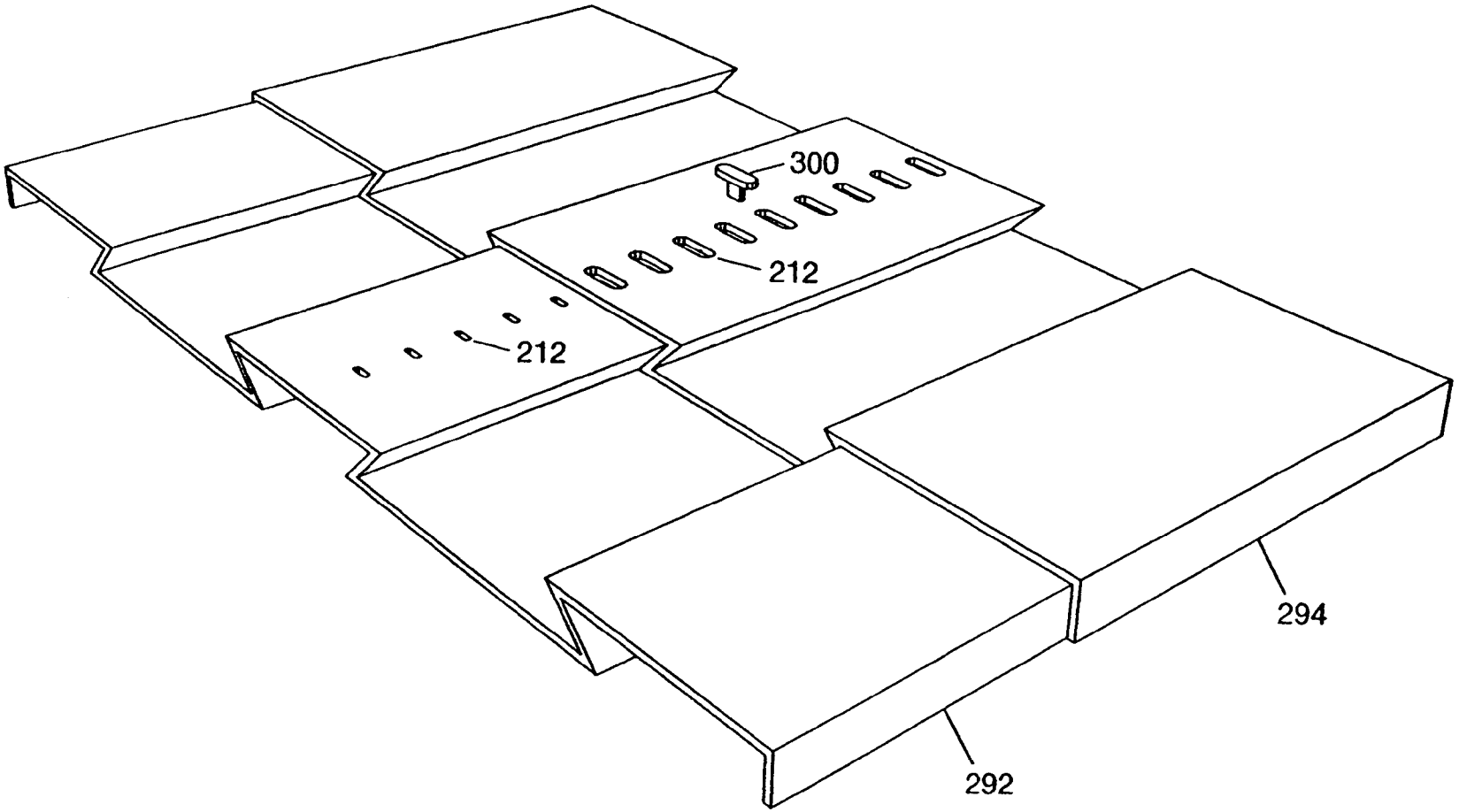
FIG. 11 is an isometric partially exploded view of a third alternative adjustable width floor panel construction

FIG. 11 illustrates a further adjustable floor panel embodiment in which the panel modules 292, 294 are shaped in a complementary manner so that they can be telescoped together. The arrangement shown in FIG. 11 contemplates that the panels define respective keystone shapes enabling a male keystone portion on one panel to be inserted into a complementary female keystone portion on the adjacent module. A series of apertures 296 is formed in the module 294 to overlay a correspondingly spaced series of apertures 298 in the module 292. A pin 300 is receivable through aligned apertures 296 and 298 to secure an adjusted width of the composite panel.

Figure 12:
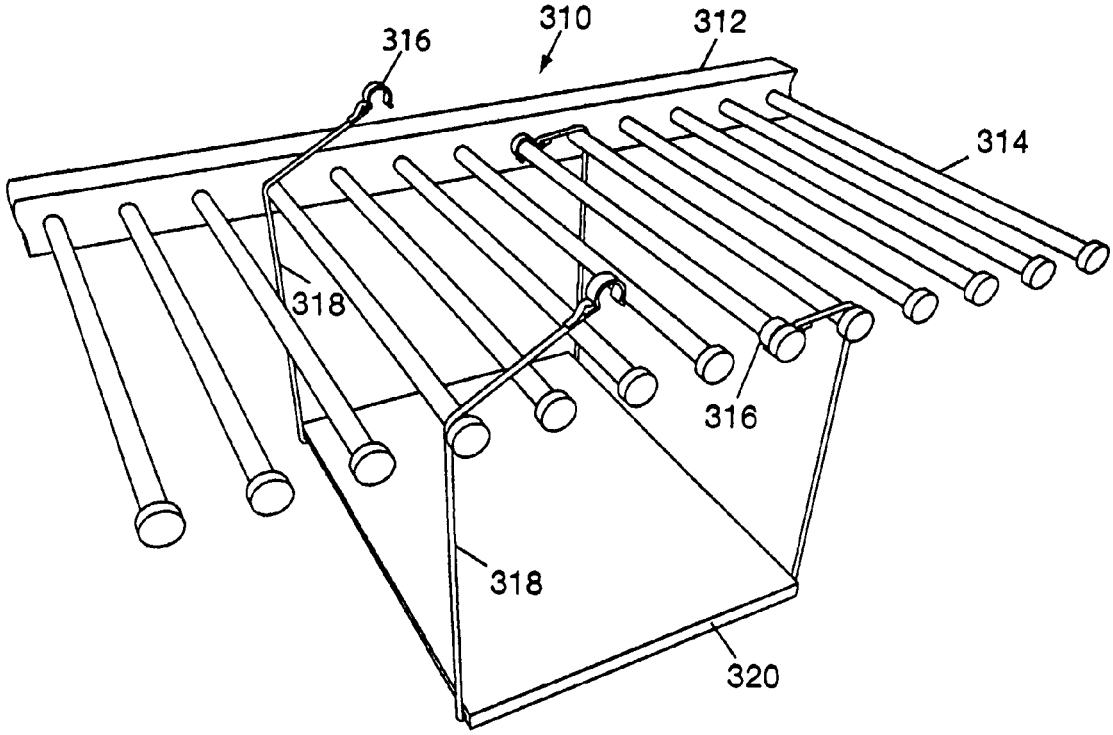
FIG. 12 is an isometric view of an additional alternative embodiment of the invention having lateral support bars cantilevered from a single rail.

Attention is now directed to FIG. 12 which depicts a further alternative embodiment 310 comprised of a single horizontally oriented longitudinal rail 312. A plurality of lateral support bars 314 are cantilevered from the rail and spaced longitudinally therealong. The rail 312 can be supported in a variety of manners such as being attached to a wall surface or hung by wires from a ceiling.

Hanger members 316 secured to web components 318 support a floor panel 320 to form a storage compartment for supporting various objects, as has been previously described.

Figure 13:
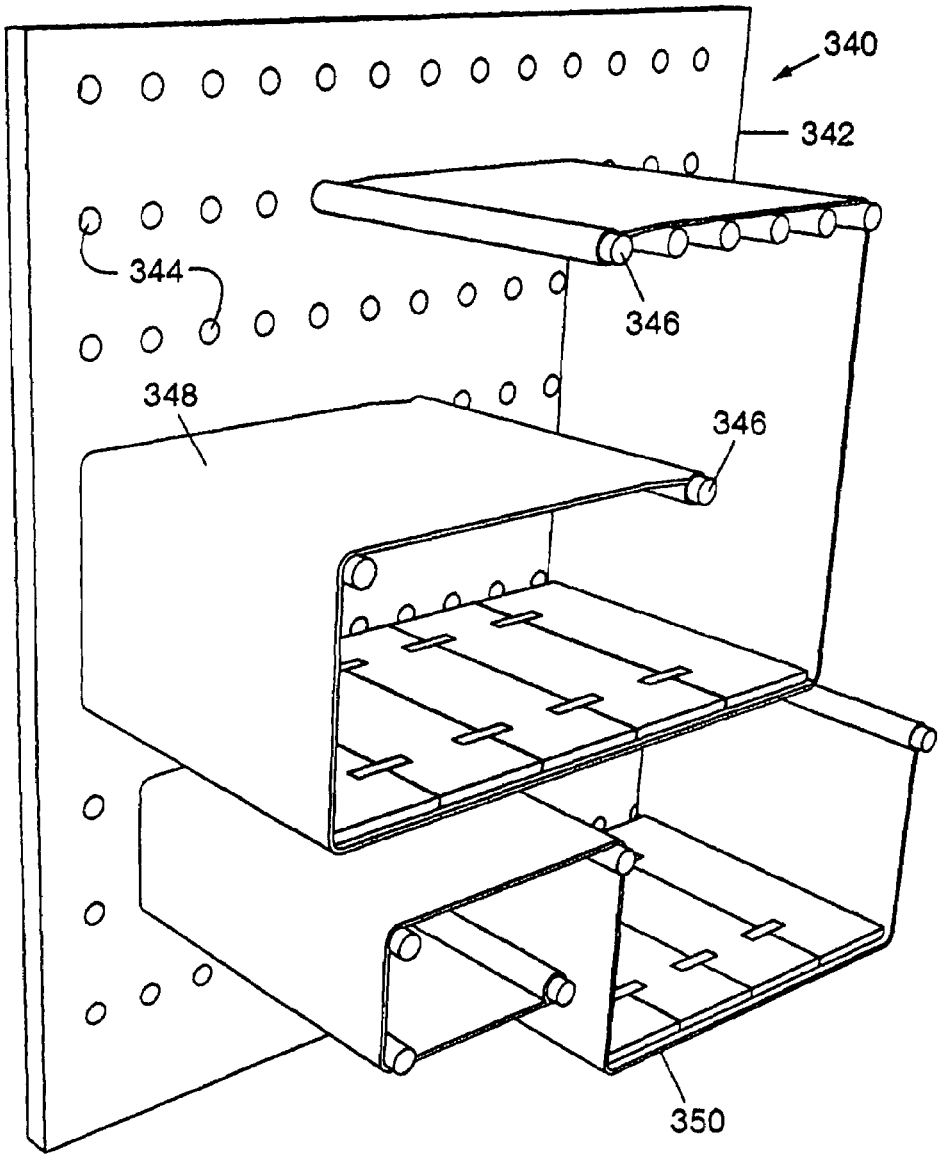
FIG. 13 is an isometric view depicting a variation of FIG. 12 in which lateral support bars are cantilevered from an apertured plate.

FIG. 13 depicts a further alternative embodiment 340 comprised of a plate 342 adapted to be mounted on a vertical wall surface. A plurality of apertures 344 are formed in the plate for securely retaining ends of a plurality of lateral support bars 346. For example, the apertures 344 and ends of bars 346 can be cooperatively threaded so as to securely cantilever the bars 346 from the plate 342.

The bars 346 can be arranged by the user to support one or more webs, e.g., 348, 350 to define variously configured and dimensioned compartments 352.

Figure 14:
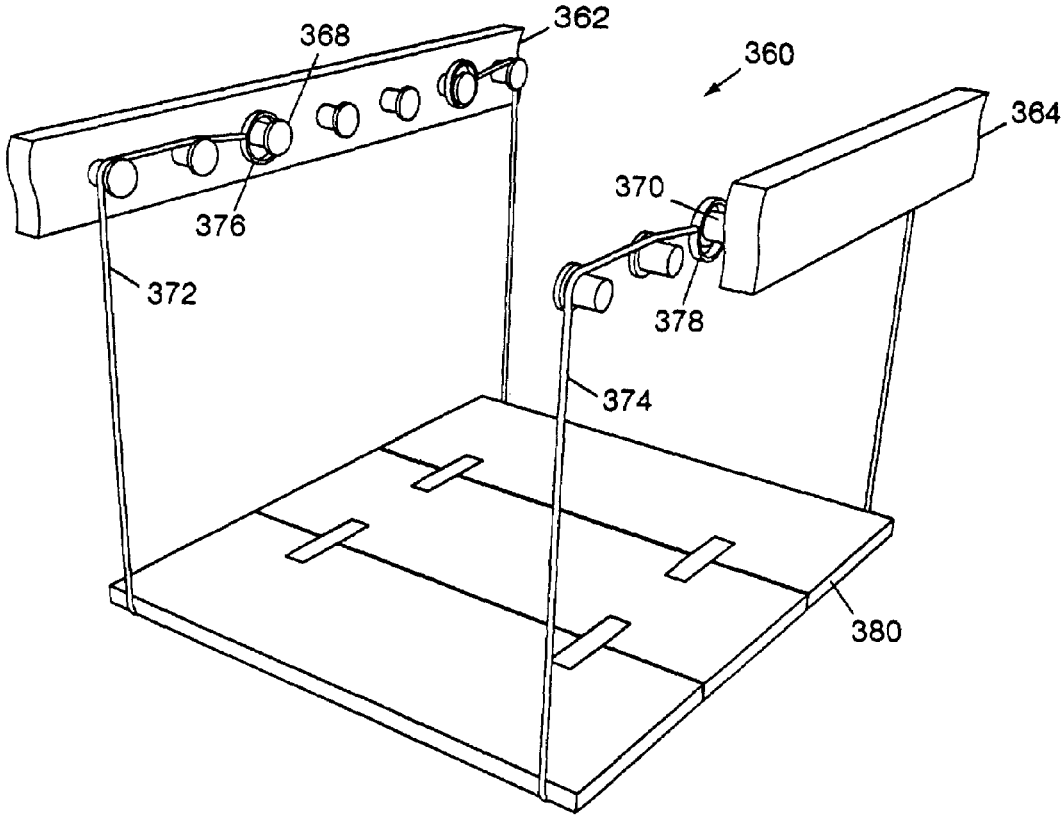
FIG. 14 is an isometric view depicting a further alternative embodiment using opposed lateral studs in lieu of bars to retain the hanger members.

Attention is now directed to FIG. 14 which illustrates a still further embodiment 360 of the invention employing horizontally oriented longitudinal rails 362 and 364. The embodiment of FIG. 14 differs from the embodiment of FIG. 6 primarily in that the bars 172 (FIG. 6) have been replaced by opposing studs, e.g., 368, 370. More particularly, rail 362 carries a plurality of longitudinally spaced studs 368. Similarly, rail 364 carries a plurality of longitudinally spaced studs 370 opposed to and aligned with studs 368. Web components 372, 374 carry hanger members 376, 378, shown as rings, for removable attachment to the studs. As with prior embodiments, the web components 372, 374 preferably support a panel 380 forming a compartment floor for supporting various objects. The rails 362, 364 can be supported in a variety of manners, e.g., on legs, as represented in FIG. 2.

Figure 15:
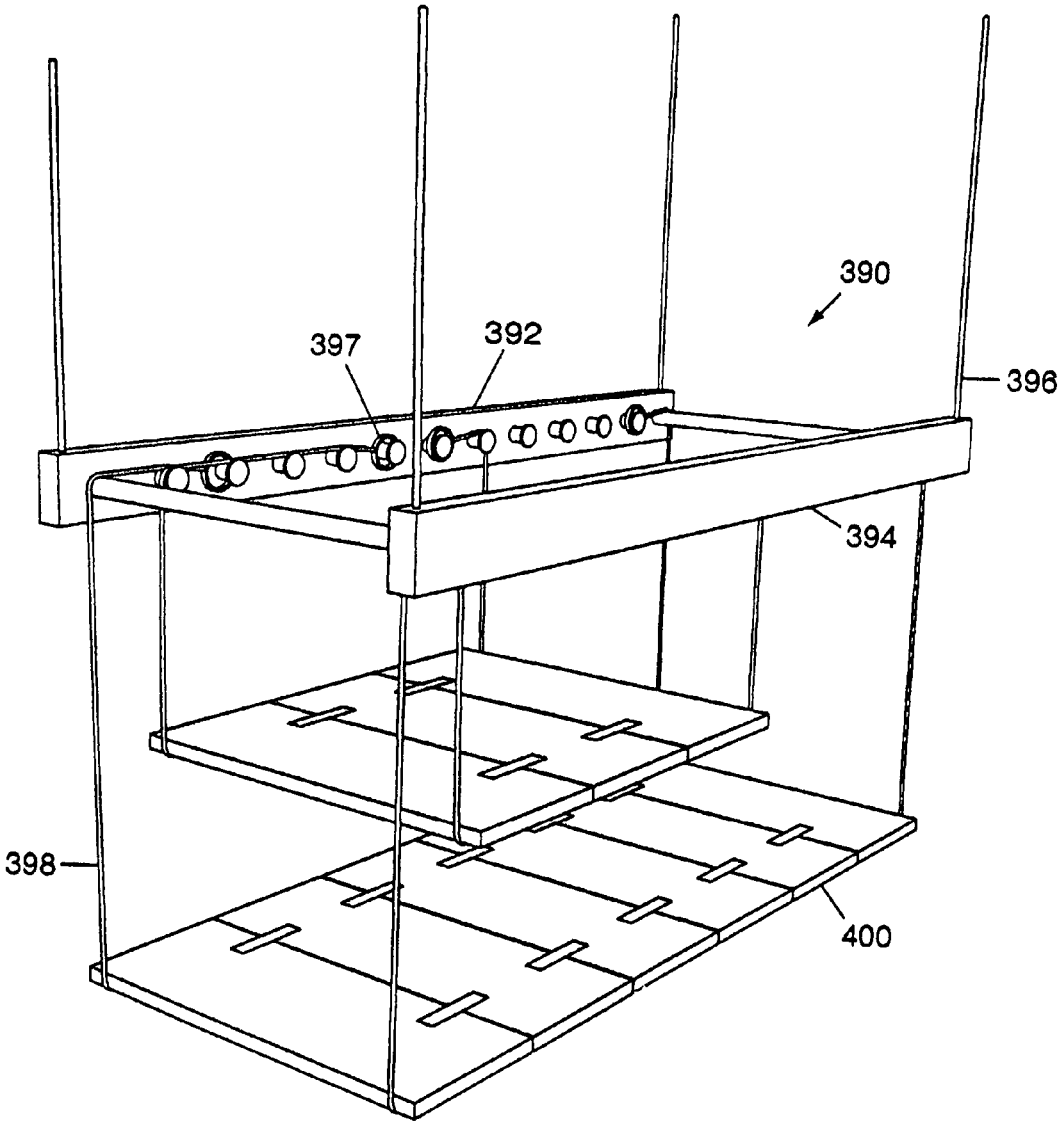
FIG. 15 is an isometric view showing an exemplary arrangement of storage compartments using the embodiment of FIG. 14.

FIG. 15 depicts a still further variation 390 of the embodiment of FIG. 14 wherein the longitudinal rails 392, 394 are suspended by vertical rods or wires 396 attached, for example, to a room ceiling. The rails 392, 394 respectively carry multiple longitudinally spaced studs as shown in FIG. 14 for retaining hanger members 396 to suspend web 398 for supporting floor panel 400.

Figure 16:
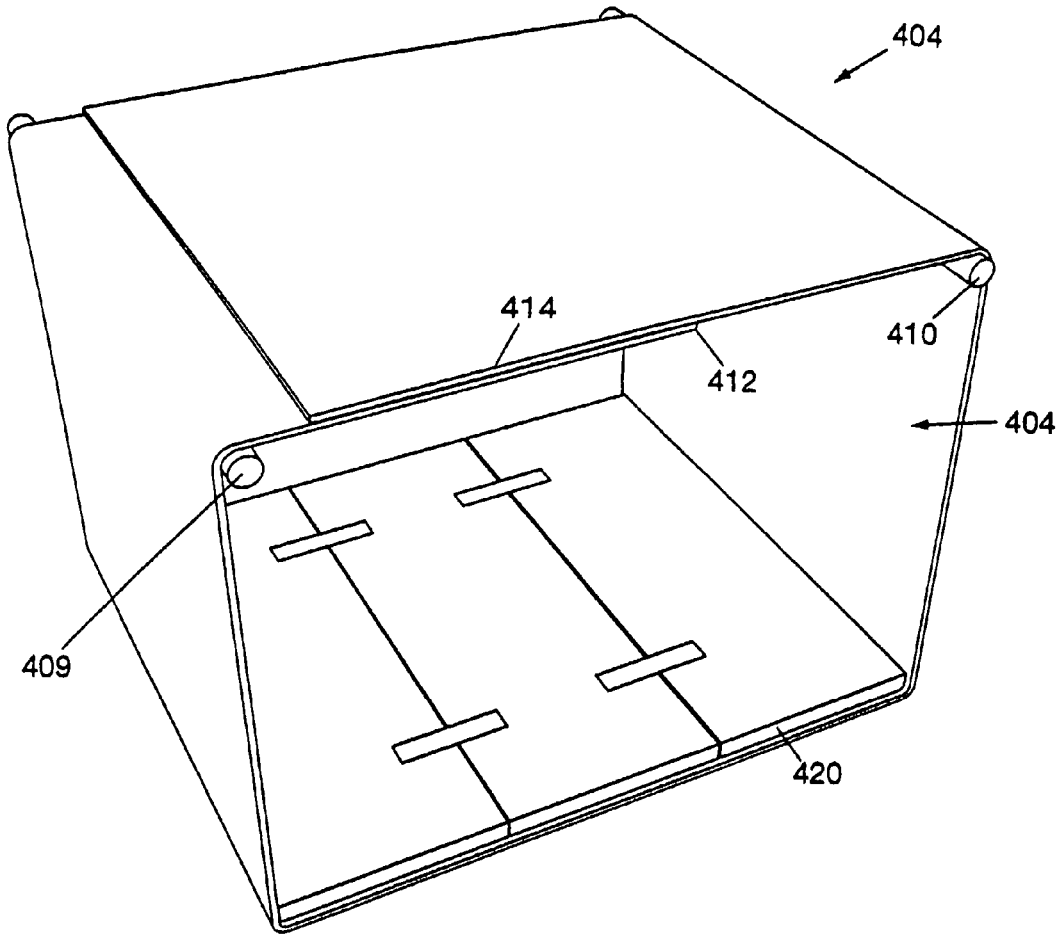
FIG. 16 is an isometric view showing a still further embodiment in which a closed loop web is suspended from spaced lateral bars.

FIG. 16 illustrates a still further variation 404 in which a compartment 406 is formed by suspending a closed loop web 408 on longitudinally spaced lateral bars 409, 410. The lateral bars 410 can be supported in a variety of manners as heretofore described. The web 408 in FIG. 16 can be formed into a dosed loop by fixedly fastening its ends 412, 414, e.g., by stitching or stapling or by adjustably fastening its ends, e.g., by hook and loop fasteners. The closed loop web 408 defines the compartment boundary and supports floor panel 420.

From the foregoing, it should now appreciated that various furniture storage unit embodiments have been disdosed enabling a user to form one or more storage compartments having height and width dimensions which can be readily varied. Moreover, embodiments of the invention enable the user to arrange and rearrange configurations or patterns of compartments. Although multiple alternative embodiments have been disclosed, it is recognized that still further alternatives and modifications will occur to those skilled in the art consistent with the spirit and scope of the present invention as defined by the appended claims.

The invention claimed is:

1. A furniture unit including at least first and second storage compartments where each compartment is defined by first and second side walls and a floor bridging said side walls bordering an open access area therebetween, said furniture unit configured to allow the height and width of each compartment to be readily varied by a user, said furniture unit comprising:

a frame including a front rail defining a plurality of user selectable front support locations spaced therealong and a rear rail mounted substantially parallel to said front rail and defining a plurality of user selectable rear support locations spaced therealong where each rear support location is aligned with a different one of said front support locations;

a two dimensional first web of flexible material having a length defined between spaced first and second laterally oriented web ends and a depth defined between spaced front and rear longitudinally oriented web edges;

means supporting said first web first end substantially horizontally at first user selected front and rear support locations and said first web second end at second user selected front and rear support locations so as to suspend said first web therefrom;

means engaging said first web between the ends thereof to form spaced first and second vertical web portions respectively defining said first compartment first and second side walls and a horizontal intermediate web portion extending therebetween defining said first compartment floor to border said open access area therebetween;

a two dimensional elongate second web of flexible material having a length defined between spaced first and second laterally oriented web ends and a depth defined between spaced front and rear longitudinal oriented web edges;

means supporting said second web first end substantially horizontally at third user selected front and rear frame support locations and said second web second end at fourth user selected front and rear support locations so as to suspend said second web therefrom; and means engaging said second web between the ends thereof to form spaced first and second vertical web portions respectively defining said second compartment first and second side walls and a horizontal intermediate web portion defining said second compartment floor to border said open access area therebetween.

2. The furniture unit of claim 1 wherein said means supporting said web ends includes a horizontally oriented elongate rod.

3. The furniture unit of claim 1 wherein said plurality of support locations comprises a plurality of horizontally spaced detents; and wherein said means supporting said first web end comprises a first rod configured to be retained by a first selected one of said detents; and said means supporting said first web second end comprises a second rod configured to be retained by a second selected one of said detents.

4. The furniture unit of claim 1 wherein said means supporting said web ends includes a hanger member.

5. The furniture unit of claim 1 wherein said plurality of support locations comprises a plurality of horizontally spaced detents; and wherein said means supporting said first web end comprises a first hanger member configured to be retained by a first selected one of said detents; and said means supporting said first web second end comprises a second hanger member configured to be retained by a second selected one of said detents.

6. The furniture unit of claim 1 wherein said front and rear support locations comprise a plurality of notches horizontally spaced along said front and rear rails.

7. The furniture unit of claim 1 wherein said front and rear support locations comprise a plurality of support bars horizontally spaced along said front and rear rails.

8. The furniture unit of claim 1 wherein said means engaging said first web includes a rigid floor panel supported on said first web intermediate web portion.

9. The furniture unit of claim 8 further including means for adjusting the width of said floor panel.

10. A method of constructing a furniture unit comprising:

providing a front rail having a plurality of horizontally spaced user selectable front support locations;

providing a rear rail having a plurality of horizontally spaced user selectable rear support locations;

mounting said front and rear rails to respectively align said front and rear support locations;

providing a two dimensional web of flexible material having a length defined between spaced laterally oriented first and second web ends and a depth defined between spaced longitudinally oriented front and rear edges;

selecting first front and rear support locations for mounting said web first end and selecting second front and rear support locations for mounting said web second end to suspend said web therebetween; and forming first and second vertical portions in said suspended web and an intermediate portion bridging said vertical portions to form an open compartment having spaced said walls and a bridging floor bordering an open access area; and placing a substantially rigid floor panel on said intermediate web portion suitable for supporting various objects.

11. The method of claim 10 including the further step of selectively adjusting the width of said floor panel.

* * * * *